United States Patent [19]

Salice

[11] 4,423,537

[45] Jan. 3, 1984

[54] HINGE BRACKET-MOUNTING PLATE ASSEMBLY HAVING A SLIDABLE LOCKING BOLT

[75] Inventor: Luciano Salice, Carimate, Italy

[73] Assignee: Deutsche Salice GmbH, Freiberg, Fed. Rep. of Germany

[21] Appl. No.: 322,233

[22] Filed: Nov. 17, 1981

[30] Foreign Application Priority Data

Nov. 20, 1980 [DE] Fed. Rep. of Germany ..... 3043789

[51] Int. Cl.[3] ..... E05D 5/02; E05D 7/12

[52] U.S. Cl. ..... 16/258; 16/382; 16/DIG. 40

[58] Field of Search ..... 16/235, 242, 254, 257, 16/258, 382, 383, 387, DIG. 40; 248/225.4, 226.1

[56] References Cited

U.S. PATENT DOCUMENTS 2,530,478 11/1950 Parent ..... 248/226.1 X

FOREIGN PATENT DOCUMENTS 2743322 4/1979 Fed. Rep. of Germany ..... 16/235
3026796 1/1982 Fed. Rep. of Germany .
2313528 12/1976 France ..... 16/242

*Primary Examiner*—Fred Silverberg
*Attorney, Agent, or Firm*—Fleit, Jacobson, Cohn & Price

[57] ABSTRACT

In the hinge bracket-mounting plate assembly the mounting plate is provided on both sides with parallel guiding grooves, in which sliding lugs angled inwardly from the flanges of the channel-shaped hinge bracket are slidable as far as stops formed by end faces of the grooves, and detents are provided for releasably locking the hinge bracket to the mounting plate. The mounting bracket is formed with a recess, which extends transversely to and connects the guiding grooves. Two sliding plates are provided, which overlap each other in the middle region of the mounting plate and are guided in the recess and formed with two substantially diagonal slots, which cross each other and extend between parts of diagonally opposite corner portions of respective sliding plates. The mounting plate is formed in its center plane between the guiding grooves with a bore, which is parallel to said grooves. A bolt is slidably mounted in the bore and protrudes from that end which is the forward end in the direction of movement of the hinge bracket as it is pushed onto the mounting plate. The bolt carries a radial pin, which extends through a slot that is formed in the bottom of the recess and parallel to the bore and which extends into the slots of the sliding plates. An abutment is provided at the rear end of the bore. A prestressed compression spring is held in the bore between the bolt and the abutment.

8 Claims, 17 Drawing Figures

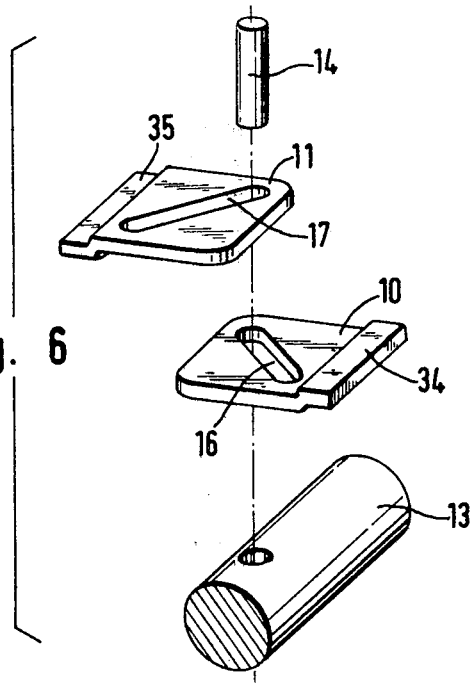
Fig. 6
Fig. 7
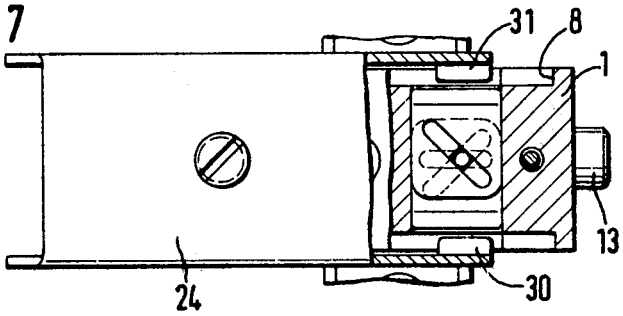
Fig. 8
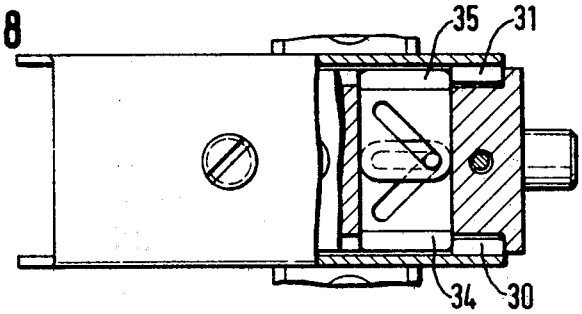

HINGE BRACKET-MOUNTING PLATE ASSEMBLY HAVING A SLIDABLE LOCKING BOLT

BACKGROUND OF THE INVENTION

This invention relates to a hinge bracket-mounting plate assembly wherein the mounting plate is provided on both sides with parallel guiding grooves, in which sliding lugs angled inwardly from the flanges of the channel-shaped hinge bracket are slidable as far as to stops formed by end faces of the grooves, and detent means are provided for releasably locking the hinge bracket to the mounting plate.

Snap action joints for fixing hinge brackets to mounting plates, e.g., to such plates which have already been mounted on carrying walls, are known in various designs. They permit a quick and simple mounting of furniture parts which have already been provided with hinges. In the usual practice the hinge brackets are fixed by screws to the associated mounting plates. Whereas this is a simple operation it takes substantial time, e.g., where a door having a plurality of hinges is to be mounted. Besides, the work is rendered more difficult by the fact that the door must usually be held in position as the hinge brackets are fixed by the screws. This disadvantage can be eliminated by the provision of snap joints between the hinge brackets and the mounting plates.

A hinge bracket-mounting arm assembly of the kind described first hereinbefore has been described and shown in the prior German Patent Application P 30 26 796.0-23.

SUMMARY OF THE INVENTION

It is an object of the invention to provide a snap action joint which permits a simple and reliable mounting of a hinge bracket on a mounting plate.

In a hinge bracket-mounting plate assembly of the kind described first hereinbefore, this object is accomplished in that the mounting bracket is formed with a recess, which extends transversely to and connects the guiding grooves, two sliding plates are provided, which overlap each other in the middle region of the mounting plate and are guided in said recess and formed with two substantially diagonal slots, which cross each other and extend between pairs of diagonally opposite corner portions of respective sliding plates, the mounting plate is formed in its center plane between the guiding grooves with a bore, which is parallel to said grooves, a bolt is slidably mounted in said bore and protrudes from that end thereof which is the forward end in the direction of movement of the hinge bracket as it is pushed onto the mounting plate, said bolt carries a radial pin, which extends through a slot that is formed in the bottom of said recess and parallel to the bore and which extends into the slots of the sliding plates, an abutment is provided at the rear end of the bore, a prestressed compression spring is held in the bore between the bolt and the abutment, the pin is adapted to engage the forward end of the slot in the bottom of the recess and in said position to hold the sliding plates in a position in which each sliding plate extends into the adjacent guiding groove, and the length of the guiding grooves from the forward edges of the sliding plates to the end faces of said guiding grooves is as large as the length of the sliding lugs. For the connection and release of the hinge brackets to and from the mounting plates it is sufficient to depress the bolt into the bore to such an extent that the pin which is displaced in the slots of the sliding plates retracts the sliding plates out of the guiding grooves so that the sliding lugs are free to move in the guiding grooves across the region of the recess.

According to a preferred further feature of the invention, a locking mechanism of the type used in retractable ball point pens is provided and adapted to lock the bolt in two different (partly extended and fully extended) positions, the bolt is adapted to be moved from one of said positions to the other in that the bolt is depressed into the bore and then released, and when the bolt is in its partly extended position the pin has been displaced in the slot formed in the bottom of the recess to such an extent that the sliding plates have been retracted from the guiding grooves. To provide an assembly which embodies that feature, the hinge bracket can be applied to the mounting plate after the bolt has been depressed so that the sliding plates no longer extend into the guiding grooves. The hinge bracket can then be pushed onto the mounting plate without need for additional unlocking steps. This will facilitate the work, particularly when a plurality of hinge brackets have been secured to a door and must be simultaneously pushed onto the associated mounting plates. When the hinge brackets have been pushed onto the mounting plates, the bolts are depressed once more so that the sliding plates are advanced into the guiding grooves. When it is desired to remove the hinge brackets from the mounting plates, all that is necessary is to depress the bolts so that the sliding plates will be retracted.

Those edge portions of the sliding plates which are adapted to extend into the guiding grooves are suitably offset in mutually opposite senses so that said edge portions lie in the plane of the guiding grooves.

According to a further preferred feature of the invention the forward edges of the sliding plates, which forward edges serve to lock the sliding lugs, or the rear edges of the sliding lugs, are oblique so that the locking plates which have not yet been fully advanced can bear on the rear edges of the sliding lugs and the latter are thus forced into backlashfree engagement with the end faces of the guiding grooves.

According to a further preferred feature of the invention, a clearance-adjusting screw is provided, which is in threaded engagement with the hinge bracket and has an annular groove, which is guided by the edges of a screw-guiding slot in the mounting plate and said groove has side faces overlapping the edges of said screw-guiding slot. The screw-guiding slot is suitably open at one end so that the groove of the adjusting screw can be inserted into the screw-guiding slot in a simple manner.

According to a preferred further feature of the invention the distance from the sliding lugs to the adjusting screw exceeds the distance from the recess to the open end of the screw-guiding slot and the guiding grooves are open-topped adjacent to the recess. When the locking plates have been retracted by means of the locking mechanism in an assembly embodying that feature, the hinge bracket can be connected to the mounting plate in that the sliding lugs of the bracket are introduced into the guiding grooves from above adjacent to the recess and the hinge bracket is then pushed to its end position, in which it is locked in that the bolt is depressed.

The sliding lugs may be guided in the guiding grooves in a major part of the length thereof with a backlash and the end portions of the guiding grooves may be upwardly or downwardly inclined or curved in order to eliminate the backlash.

BRIEF DESCRIPTION OF THE DRAWINGS

An embodiment of the invention will now be explained more in detail with reference to the accompanying drawings, in which FIG. 6 is an exploded view showing the axially slidable bolt and its radial pin and the locking plates which are displaceable by said pin, FIG. 7 is a top plan view showing partly in section the hinge bracket as it is pushed onto the mounting plate, FIG. 8 is a view similar to FIG. 7 and shows the hinge bracket and the mounting plate releasably locked to each other.

DETAILED DESCRIPTION OF THE DRAWINGS

Figure 1:
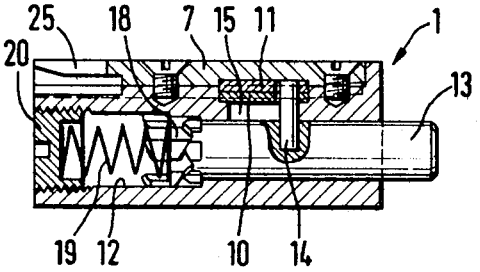
FIG. 1 is a longitudinal sectional view showing a mounting plate.

The mounting plate 1 is substantially a parallelepiped and has side flanges 2, 3, which are formed with bores 4 for fixing screws. The mounting plate is also formed on both sides with guiding grooves 5, 6, which are defined by stepped side edge portions of the body of the mounting plate 1 and by a cover plate 7, which is fixed by screws. The forward end faces 8 of the guiding grooves 5, 6 constitute stops.

The body of the mounting plate 1 is formed in its surface facing the cover plate 7 with a transverse recess 9. Sliding plates 10, 11, which partly overlap each other, are slidably guided in the recess 9.

Figure 2:
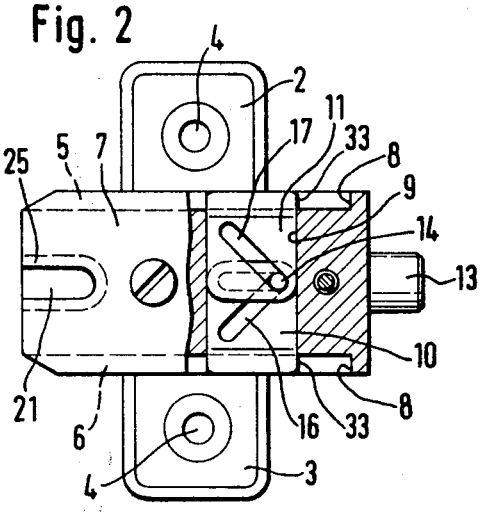
FIG. 2 is a top plan view showing the mounting plate of FIG. 1, partly in section.
Figure 3:
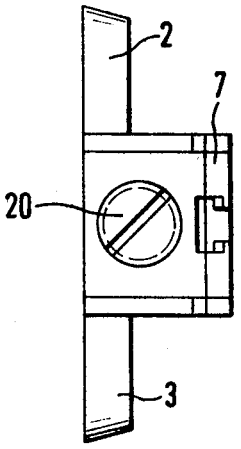
FIG. 3 is a rear elevation showing the mounting plate of FIG. 1.

The body of the mounting plate 1 is formed with a centrally disposed, axial bore 12, in which a bolt 13 is longitudinally slidably guided. The bolt 13 carries a radially protruding pin 14, which extends through a slot 15 formed in the bottom of the recess 9. The transversely slidable plates 10, 11 are provided with crossing diagonal slots 16, 17, which are shown in FIG. 2. As is apparent from FIG. 1 the pin 14 extends also through the slots 16, 17 so that the overlapping sliding plates 10, 11 can be laterally reciprocated in that the pin 14 is displaced in the slot 15. The bolt 13 has a profiled inner end portion, which will be described more fully hereinafter, and constitutes part of locking mechanism of the type used in retractable ball point pens. That profiled inner end portion cooperates with beveled ribs of a slider 18, which is urged by a compression spring 19 towards the bolt 13. The compression spring 19 is prestressed and is held between the slider 18 and an abutment 20, which consists of a screw plug 20 that closes the bore 12. The surface of the bore 12 is also formed with ribs, which together with the profiled inner end portion of the bolt 13 and the spring-loaded slider 18 constitute the locking mechanism which will be described more in detail hereinafter and is of the type used in retractable ball point pens.

The locking mechanism of the type used in retractable ball point pens holds the bolt in either of two (partly extended and fully extended) positions, in which it is partly extended and fully extended, respectively, from the bore 12. In FIGS. 1 and 2 the bolt 13 is shown in its fully extended position, in which it holds the sliding plates 10, 11 in their extended position, in which they extend into the guiding grooves 5, 6. FIG. 7 shows the bolt 13 in its partly extended position, which is also defined by the locking mechanism and in which the locking plates 10, 11 are retracted from the guiding grooves.

The rear end portion of the mounting plate 1 is provided on its outside surface with an opening 21, which is T-shaped in cross-section. The opening 21 is open at the rear and has a rounded forward end portion. The opening 21 constitutes a guide for an adjusting screw 23, which is in threaded engagement with the hinge bracket 24 and is formed with an annular groove. Adjacent to the opening 21, the mounting plate 1 is formed with edge strips 25, which overlap the opening 21 and have inside surfaces which together with the bottom of the opening 21 define guiding grooves. The end portions of the edge strips are beveled, as is shown in FIG. 1, in order to facilitate the insertion of the T-shaped end portion 26 of the adjusting screw 23 into the opening 21.

Figure 4:
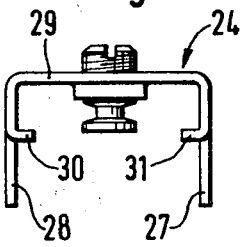
FIG. 4 is a front elevation showing the hinge bracket.
Figure 5:
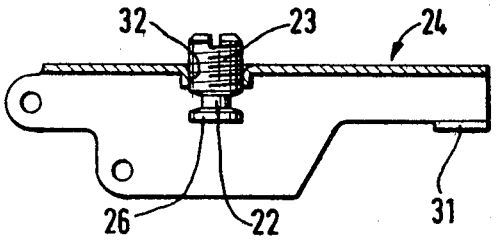
FIG. 5 is a longitudinal sectional view showing the hinge bracket of FIG. 4.

As is particularly apparent from FIG. 4, the hinge bracket 24 is channel-shaped and comprises flanges 27, 28 which are connected by a web 29. The forward portion of the hinge bracket 24 is formed with sliding lugs 30, 31, which are angled inwardly from the flanges 27, 28. The web 29 is formed with a punched bore 32, which is provided with a collar and with female screw threads for the adjusting screw 23.

The sliding lugs 30, 31 have the same length as the forward portions of the guiding grooves 5, 6 between the end faces 8 and the forward edges 33 of the sliding plates 10, 11.

As is apparent from FIG. 6, the forward edge portions 34, 35 of the sliding plates 10, 11 are offset in mutually opposite senses so that said edge portions will lie in the plane of the guiding grooves 5, 6 although the sliding plates 10, 11 overlap each other.

FIG. 7 shows how the hinge bracket 24 is pushed onto the mounting plate 1. The movement of the sliding lugs 30, 31 will not be obstructed by the end edges of the sliding plates 10, 11 because the latter will be held in a retracted position by the locking mechanism. When the hinge arm 24 has been pushed to its end position, in which the sliding lugs 30, 31 engage the end faces 8 of the guiding grooves 5, 6, pressure is applied to the bolt 13 so that it is moved under the force of the spring 19 to its fully extended position, in which the bolt 13 is held by the locking mechanism. This movement of the bolt 13 causes the sliding plates 10, 11 to be extended so that their edge portions 34, 35 enter the guiding grooves 5, 6 and thus lock the sliding lugs 30, 31 as is indicated in FIG. 8.

The sliding lugs 30, 31 are guided in the guiding grooves 5, 6 with a slight backlash. Because each guiding groove 5, 6 has a forward portion which is slightly upwardly inclined, as is indicated in dotted lines in FIG. 1, the sliding lugs 30, 31 will be canted and slightly deformed in that portion and will thus be held in the groove without backlash when the parts are locked.

To release the hinge bracket from the mounting plate when the parts are locked in the position shown in FIG. 8, the bolt 13 must be depressed so that it will then be locked by the locking mechanism in its partly extended position, which is shown in FIG. 7 and in which the hinge bracket 24 can easily be pulled from the mounting plate 1.

The locking mechanism of the type used in retractable ball point pens will now be explained more in detail with reference to FIGS. 9 to 17.

Figure 9:
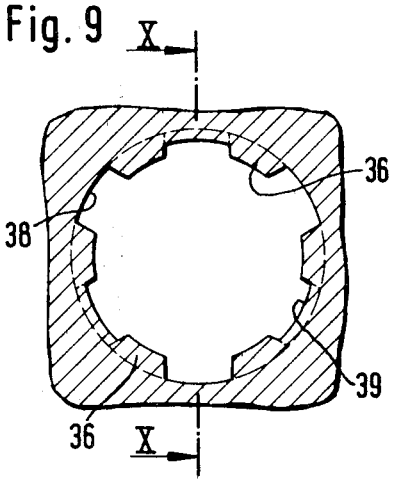
FIG. 9 is a sectional view taken on line IX—IX in FIG. 10 which extends through that portion of the mounting plate that is provided with the bore for the bolt, on the level of the surface provided with the guide ribs of the locking mechanism.
Figure 10:
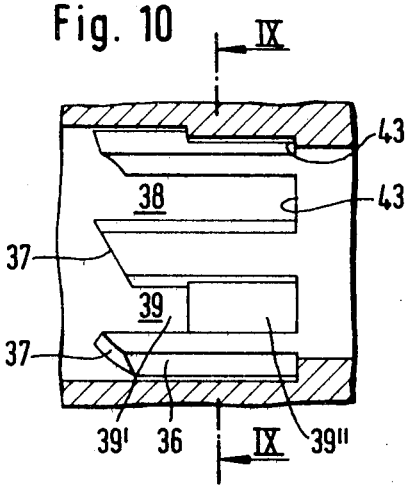
FIG. 10 is a longitudinal sectional view taken on line X—X in FIG. 9 through the bore.

As is apparent from FIGS. 9 and 10, six axial guide ribs 36 are provided on the surface of the bore 12 and are equally angularly spaced apart. At their ends facing the abutment 20 for the compression spring 19, the ribs have end faces 37 sloping in the same sense. Grooves 38 and 39 are defined in alternation between adjacent ribs 36. The grooves 38 have a larger depth throughout their length than the grooves 39 and the bottom of each groove 38 is defined by the radius of the bore 12. Axially outwardly of the grooves 38, the bore 12 has a portion which is smaller in diameter and which has the same radius as the crests of the ribs 36.

Each groove 39 is stepped in depth and has an inlet portion 39′, which has the same depth as the grooves 38, and an adjoining portion 39″ of smaller depth.

Figure 12:
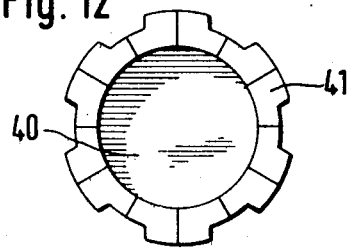
FIG. 12 is a bottom view showing the bolt.
Figure 14:
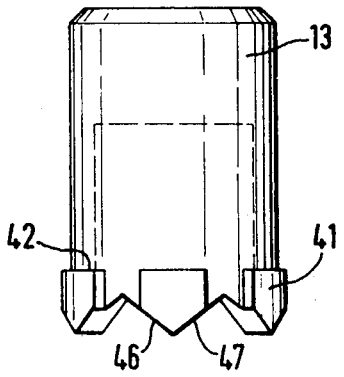
FIG. 14 is a side elevation showing the detent pin of FIG. 12 and FIGS. 15 to 17 are developed views showing the ribbed surface of the bore and the profiled side portions of the spring-loaded slider and the bolt when the latter is in its fully extended and partly extended positions, respectively.

The bolt 13 shown in FIGS. 12 and 14 has a central blind bore 40 and at the rim of said bore is formed with six ribs 41, which protrude radially outwardly from the body of the bolt 13 and have the same width as the grooves 38, 39. The axially outer end faces of the ribs 41 constitute shoulders or stops 42. The ribs 41 are guided in the grooves 38 and 39, and have such a radial extent that they can move also in the shallower portions 39″ of the grooves 39 until the shoulders 42 engage the end faces 43 of the grooves 38, 39.

Figure 11:
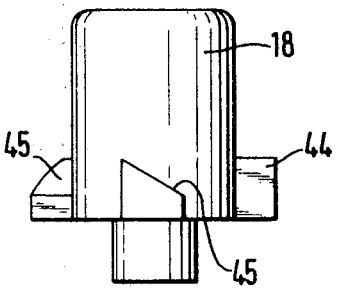
FIG. 11 is a side elevation showing the spring-loaded slider of the locking mechanism.
Figure 13:
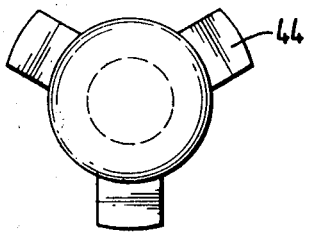
FIG. 13 is a top plan view showing the slider of FIG. 11.

The slider 18 shown in FIGS. 11 and 13 is cylindrical and is so large in diameter that the slider 8 can be slidably inserted into the bore 40 of the bolt 13 but will not bear on the bottom of the bore 40. The slider 18 is provided with three radially outwardly protruding ribs 44, which are equally angularly spaced apart and have end faces 45 sloping in the opposite sense of the end faces 37 of the ribs 36. The ribs 44 have such a radial extent that they can slide over the bottom of the grooves 38 but can slide only in the deeper portion 39′ of each groove 39. In the grooves 39, the ribs 44 will engage the shoulder between the portions 39′ and 39″.

The bore 40 in the bolt 13 is surrounded at its open end by an end face consisting of sloping surfaces 46, 47 which are defined by a zig-zag line. Two surfaces 46, 47 sloping in opposite senses meet at the center line of each rib 41. The surfaces 46, 47 slope at the same angle as the sloping end faces 37, 45.

The mode of operation of the locking mechanism of the type used in retractable ball point pens will now be explained more in detail with reference to FIGS. 15 to 17, where lines provided with no reference characters indicate the ribs 36 in the bore 12 in a developed view. The zig-zag line marked with short strokes represents a developed view of the ribbed edge of the bolt 13. Hatched area represent the ribs 44 of the slider 18 in section.

Figure 15:
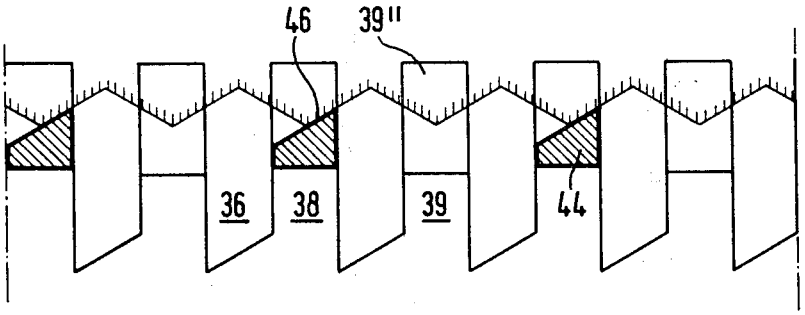

In FIG. 15 the locking mechanism is shown in the position assumed when the bolt 13 is in its fully extended position, in which the ribs 44 of the spring-loaded slider 18 bear on the right-hand sloping surfaces 46 at the rim of the bolt 13 so that the shoulders 42 of the ribs 41 will be urged against the end faces 43 of the grooves 38, 39.

Figure 16:
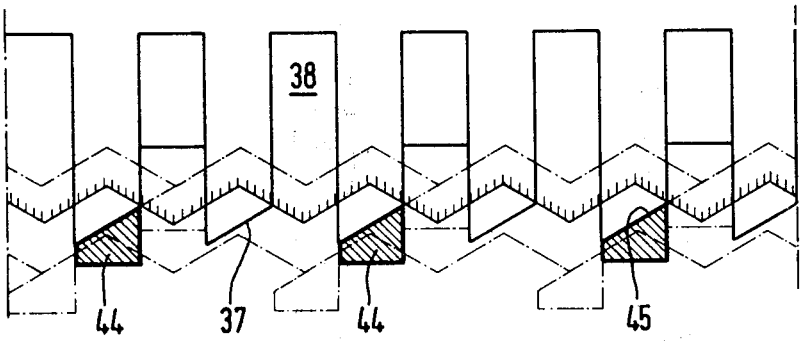

When axial pressure is then applied to the bolt 13 in the manner indicated in FIG. 16, the bolt pin 13 will move the slider 18 in the grooves 38 against the force of the spring 19 until the axially inner end faces of the ribs 44 have moved past the axially inner ends of the ribs 36. When the ribs 44 have thus been moved out of the grooves 38, the sloping surfaces 45 will slide on the sloping end faces 46 of the ribs 41 of the bolt 13 until the axially inner end faces of the ribs 44 engage the oppositely sloping surfaces 47. As the sloping surfaces slide on each other, the slider 18 is rotated. When the detent pin is subsequently released, the sloping surfaces 45 will slide on the sloping end faces 37 of the ribs 36 until the ribs 44 snap into the grooves 39, in which the axially outward movement to the ribs 41 of the bolt 13 is limited by the engagement of the axially outer end of each rib 44 with the shoulder between the portions 39′ and 39″ of different depths.

Figure 17:
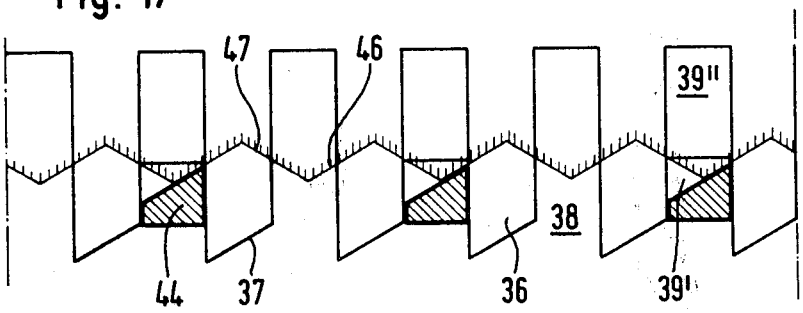

This position of the bolt 13 and the slider 18 is apparent from FIG. 17.

What is claimed is:

1. A hinge bracket-mounting plate assembly wherein the mounting plate is provided on both sides with parallel guiding grooves, sliding lugs angled inwardly from the flanges of the channel-shaped hinge bracket are slidable in the grooves until the lugs abut stops formed by end faces of the grooves, and detent means are provided for releasably locking the hinge bracket to the mounting plate, characterized in that the mounting bracket is formed with a recess, which extends transversely to and connects the guiding grooves, two sliding plates are provided, said sliding plates overlap each other in the middle region of the mounting plate and are guided in said recess, each sliding plate is formed with a substantially diagonal slot, which cross each other and extend between pairs of diagonally opposite corner portions of respective said sliding plates, the mounting plate is formed in its center plane between the guiding grooves with a bore, which is parallel to said grooves, a bolt is slidably mounted in said bore and protrudes from that end thereof which is the forward end in the direction of movement of the hinge bracket as it is pushed onto the mounting plate, said bolt carries a radial pin which extends through a slot, said slot is formed in the bottom of said recess and is parallel to the bore, said radial pin extends into the diagonal slots of the sliding plates, an abutment is provided at the rear end of the bore, a prestressed compression spring is held in the bore between the bolt and the abutment, the pin is adapted to engage the forward end of the slot in the bottom of the recess to hold the sliding plates in a position in which each sliding plate extends into the adjacent guiding groove, and the length of the guiding grooves from the forward edges of the sliding plates to the end faces of said guiding grooves is as large as the length of the sliding lugs.

2. A hinge bracket-mounting arm assembly according to claim 1, characterized in that a locking mechanism of the type used in retractable ball point pens is provided and adapted to lock the bolt in two different positions, said positions including a partly extended position and a fully extended position, the bolt is adapted to be moved from one of said positions to the other in that the bolt is depressed into the bore and then released, and when the bolt is in the partly extended position the pin has been displaced in the slot formed in the bottom of the recess to such an extent that the sliding plates have been retracted from the guiding grooves.

3. A hinge bracket-mounting plate assembly according to claim 1 or 2, characterized in that edge portions of the sliding plates which are adapted to extend into the guiding grooves are suitably offset in mutually opposite senses so that said edge portions lie in the plane of the guiding grooves.

4. A hinge bracket-mounting plate assembly according to claim 3, characterized in that the forward edges of the sliding plates serve to lock the sliding lugs, or the rear edges of the sliding lugs, are oblique.

5. A hinge bracket-mounting plate assembly according to claim 4, characterized in that a clearance-adjusting screw is provided in threaded engagement with the hinge bracket and has an annular groove, said groove is guided by the edges of a screw-guiding slot in the mounting plate and said groove has side faces overlapping the edges of said screw-guiding slot.

6. A hinge bracket-mounting plate assembly according to claim 5, characterized in that the screw-guiding slot is open at one end.

7. A hinge bracket-mounting plate assembly according to claim 6, characterized in that the distance from the sliding lugs to the adjusting screw exceeds the distance from the recess to the open end of the screw-guiding slot and the guiding grooves are open-topped adjacent to the recess.

8. A hinge bracket-mounting arm assembly according to claim 7, characterized in that the sliding lugs are guided in the guiding grooves in a major part of the length thereof with a backlash and the end portions of the guiding grooves are inclined in order to eliminate the backlash.

* * * * *